US006726522B2

(12) United States Patent
Muramatsu et al.

(10) Patent No.: US 6,726,522 B2
(45) Date of Patent: Apr. 27, 2004

(54) OBJECT DISPLAY METHOD AND APPARATUS

(75) Inventors: Kenichi Muramatsu, Yokohama (JP); Yoh Kuno, Kawasaki (JP)

(73) Assignee: Namco, Ltd. (JP)

( * ) Notice: Subject to any disclaimer, the term of this patent is extended or adjusted under 35 U.S.C. 154(b) by 19 days.

(21) Appl. No.: 09/928,170

(22) Filed: Aug. 9, 2001

(65) Prior Publication Data

US 2003/0143916 A1 Jul. 31, 2003

Related U.S. Application Data

(62) Division of application No. 09/354,000, filed on Jul. 15, 1999, now Pat. No. 6,468,124.

(30) Foreign Application Priority Data

Jul. 17, 1998 (JP) ..... 10-203779

(51) Int. Cl.[7] ..... A63H 33/22

(52) U.S. Cl. ..... 446/219; 446/485; 463/49

(58) Field of Search ..... 273/353, 127 R; 40/436, 442; 446/311, 310, 219, 485, 308, 309; 434/16, 20, 21, 22, 24; 463/2, 5, 51–54, 56–57, 49; 472/71, 77, 63, 57

(56) References Cited

U.S. PATENT DOCUMENTS 1,227,393 A * 5/1917 Cressman ..... 38/49
1,996,457 A * 4/1935 Chandlee ..... 40/427
2,403,522 A * 7/1946 Goldstein et al. ..... 124/4
2,837,862 A * 6/1958 Cleveland ..... 446/1
2,845,270 A 7/1958 Durant
2,899,205 A 8/1959 Zale
3,620,534 A 11/1971 Einfalt
3,790,172 A 2/1974 Nakamura
3,894,353 A * 7/1975 Oguchi ..... 446/486
4,023,794 A * 5/1977 Adams ..... 472/63
4,026,066 A * 5/1977 Reiner et al. ..... 312/125
4,068,841 A * 1/1978 Kuna et al. ..... 446/82
4,180,931 A * 1/1980 Osch ..... 250/214 PR
4,353,701 A * 10/1982 Greenberg ..... 434/259
4,464,115 A 8/1984 Simpson et al.
5,041,044 A * 8/1991 Weinreich ..... 40/442
5,190,286 A 3/1993 Watanabe et al.
5,213,335 A 5/1993 Dote et al.
5,528,425 A * 6/1996 Beaver ..... 352/85
5,569,085 A 10/1996 Igarashi et al.
6,110,039 A 8/2000 Oh
6,468,124 B1 * 10/2002 Muramatsu et al. ..... 446/219

* cited by examiner

*Primary Examiner*—Derris H. Banks
*Assistant Examiner*—Dmitry Suhol
(74) *Attorney, Agent, or Firm*—Gray Cary Ware & Freidenrich LLP

(57) ABSTRACT

An object display method and apparatus is disclosed which can easily display changeover of an entity, and an amusement apparatus is disclosed which can display a simulated burst having reality and punch. The method and apparatus first displays only one of the objects and hides other objects from the field of view. Then, the method and apparatus displays the previously hidden objects and at the same time hides the previously displayed object.

2 Claims, 9 Drawing Sheets

OBJECT DISPLAY METHOD AND APPARATUS

CROSS REFERENCE TO RELATED APPLICATIONS

This application is a divisional of and claims the benefit of U.S. application Ser. No. 09/354,000, filed Jul. 15, 1999, now U.S. Pat. No. 6,468,124 the disclosure of which is incorporated herein by reference.

BACKGROUND OF THE INVENTION

1. Field of the Invention

The present invention relates to an object display method suitable for display or the like and apparatus therefor, and an amusement apparatus using the object display apparatus for a target or the like.

2. Description of the Relevant Art

In the past, replacement of objects to be displayed has been easily done using computer graphics (CG) and the object to be displayed can be optionally changed. Since CG uses a monitor for display, however, even if the display is powerful, it is inferior to the entity or object itself. The same thing can be said of an amusement apparatus. For example, in a shooting game, a state that a target is hit and crashed is displayed more powerful by an entity than CG.

Therefore, there is known a method in which an entity is broken up into several parts and scattered, in a conventional shooting game apparatus.

In the above-mentioned amusement apparatus, however, if it is tried to automatically recover the scattered parts and reassemble them, not only the apparatus becomes large-scale, but also the operation takes time, hence there has been a problem that the game does not progress smoothly. To solve this problem, there is proposed a method in which when a signal indicating that the target was hit is received, the target is not burst, but only knocked down. However, such a display is far from an actual burst, thus lacking reality and punch.

In view of the above situation, it is an object of the present invention to provide an object display method and apparatus which can easily display replacement of an entity, and an amusement apparatus using the apparatus, which can display simulated burst having reality and punch.

SUMMARY OF THE INVENTION

To solve the above-mentioned problems, the present invention is characterized in that a plurality of objects to be displayed can be displayed in a display position visible from a generally predetermined direction, only one of said objects to be displayed is displayed and other objects to be displayed are hidden from the field of view, and one of the objects to be displayed hidden before in the display position appears, at the same time when the object to be displayed appearing in said display position is hidden from the field of view.

Furthermore, to attain the above-mentioned objects, the present invention is characterized in that an amusement apparatus using the above-described object display apparatus has two objects to be displayed which appear in the display position generally visible from a predetermined direction, and appearance/disappearance provided for each of said two objects to be displayed, means for changing over each object to be displayed from a state that it appears in said display position and a state that it is hidden from the field of view, wherein one of said two objects to be displayed represents the object before bursting, and the other represents the object at the time of bursting.

The amusement apparatus of the present invention is effective if said object to be displayed representing the object at the time of bursting is fragmentary bodies obtained by forming an entity in a plurality of fragments.

The amusement apparatus of the present invention is effective if burst display means is provided for blowing off the plurality of fragmentary bodies upward in the display position.

The amusement apparatus of the present invention is effective if the burst display means has a hitting device for lifting the plurality of fragmentary bodies.

The amusement apparatus of the present invention is effective if the hitting device has a hitting member for hitting the fragmentary bodies, and a hitting actuating means for actuating the hitting member.

The amusement apparatus of the present invention is effective if the hitting device has a hitting lever attached to the apparatus body rotatably around a rotation fulcrum, at one end of which the hitting member is secured, and the hitting actuating means actuates the hitting member via the hitting lever member.

The amusement apparatus of the present invention is effective if the position of the rotation fulcrum of the hitting lever member and the position of the hitting member are set to be roughly the same height.

The amusement apparatus of the present invention is effective if a protrusion is provided on a hitting face of the hitting member.

The amusement apparatus of the present invention is effective if the protrusion is formed in a hill shape, as seen from the predetermined direction.

The amusement apparatus of the present invention is effective if the hitting face of the hitting member supported by the hitting lever member is so formed that a face away from the rotation fulcrum of the hitting lever member has a larger hill shape than that of a face close to the rotation fulcrum.

The amusement apparatus of the present invention is effective if the fragmentary bodies are formed using substantially the same object as the entity used for the object to be displayed before bursting.

The amusement apparatus of the present invention is effective if a closed space is provided over the hitting member, and the plurality of fragmentary bodies are lifted in the closed space.

The amusement apparatus of the present invention is effective if the closed space is a space spreading in the horizontal direction rather than its depth, as seen from the predetermined direction, and a plate member on the upstream side which constitutes the closed space is a transparent plate, as seen from the predetermined direction.

The amusement apparatus of the present invention is effective if an inclined face is formed for guiding the lifted fragmentary bodies onto the hitting member at a bottom of the closed space.

The amusement apparatus of the present invention is effective if a hiding member for hiding fragmentary bodies moving on the inclined face is provided on the transparent plate member or in the vicinity thereof.

The amusement apparatus of the present invention is effective if a sensor for detecting a predetermined ray is provided on the entity used for the object to be displayed before bursting.

The amusement apparatus of the present invention is effective if the object to be displayed before bursting is an image of the entity appearing in the display position via a half mirror.

The amusement apparatus of the present invention is effective if the object to be displayed before bursting is an entity movable between a position where the object to be displayed appears in the display position and a position where the object to be displayed is hidden from the field of view.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

The figures of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

An embodiment of the present invention will now be described in accordance with the accompanying drawings.

Figure 1:
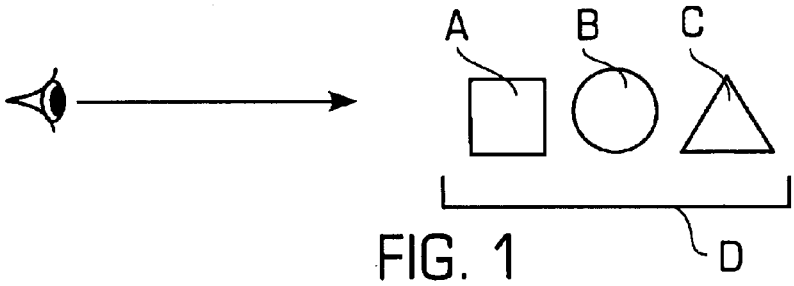
FIG. 1 is a schematic diagram showing an object display apparatus according to the present invention.

FIG. 1 is a diagram showing the principle of the object display method according to the present invention.

Figure 2A:
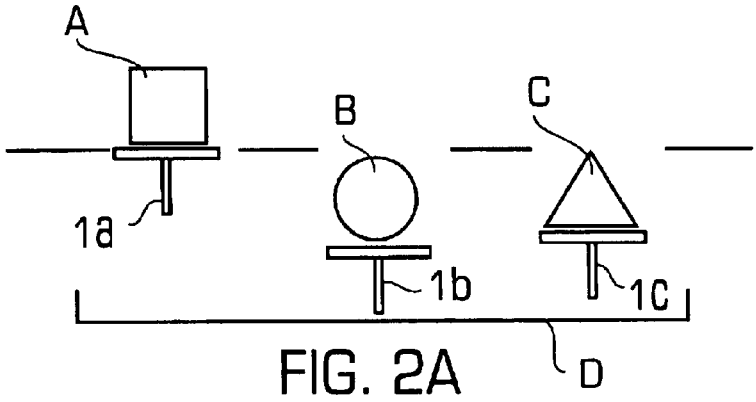
FIGS. 2(*a*), (*b*) and (*c*) are diagrams showing a state in which a different object to be displayed is displayed.
Figure 2B:
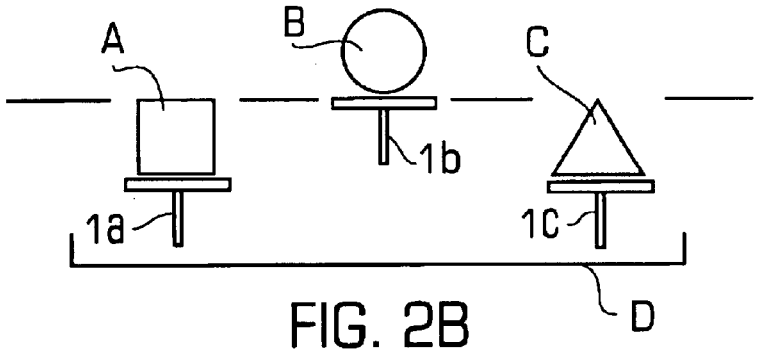
Figure 2C:
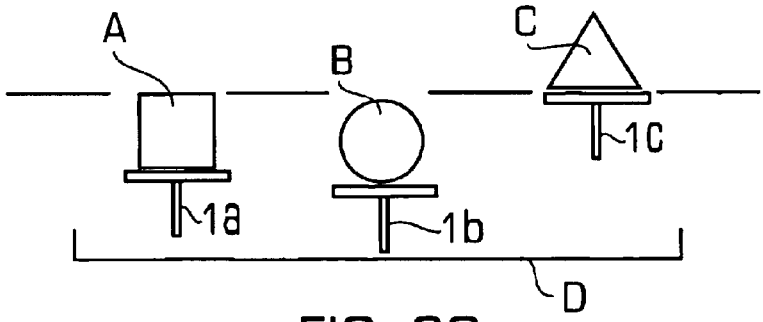

Referring to FIG. 1, reference numerals A, B and C are objects to be displayed, and these objects A, B and C are lined up in the display position D, along the direction of eyesight, as shown by an arrow L. That is to say, the objects A, B and C are lined up in the direction seen by the eyes. The objects A, B and C are entities, and as shown in FIG. 2, they are placed, respectively, on lifting devices as the appearance/disappearance means, and movable between a position where they appear in the display position D and a position where they are hidden from the display position D. In FIG. 2(*a*), only the object A appears on the display position D, and objects B and C are both located in a lowered hidden position. Moreover, in FIG. 2(*b*), only the object B appears on the display position D, and objects A and C are hidden, and in FIG. 2(*c*), only the object C appears on the display position D, and objects A and B are hidden.

Figure 3:
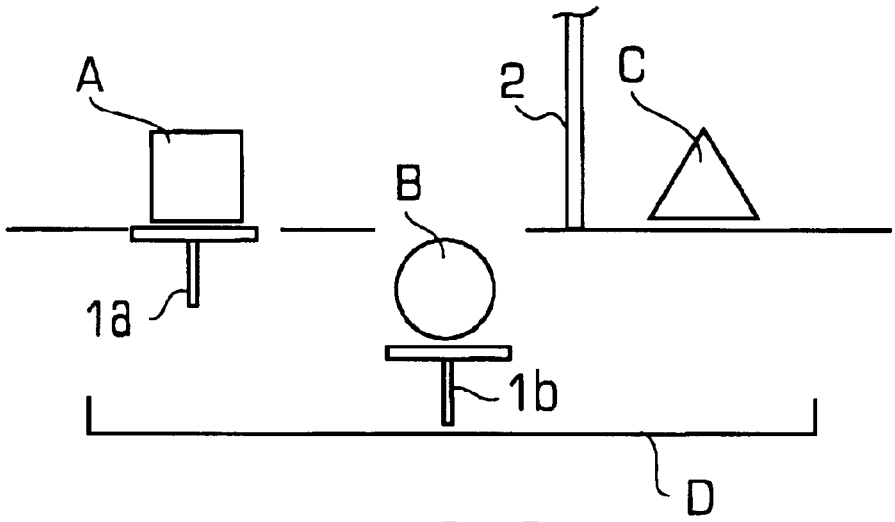
FIG. 3 is a diagram showing a variation of FIG. 2.

The object C located on the rearmost part in the direction of eyesight, as shown in FIG. 3, may be hidden by a screen 2 as the appearance/disappearance means. That is to say, the construction may be such that the object C itself is in a fixed position, and the screen 2 is movable between a position where the object is hidden by the screen 2 and a position where the object is displayed. Furthermore, in FIG. 3, the screen is moved upward to display the object C, however, the moving direction may be downward or the horizontal direction.

With the display apparatus constituted as described above, in a state that only the object A appears on the display position D, for example, as shown in FIG. 2(*a*), when a signal for changing the object to be displayed is generated by a proper method, the object A mover, to a hidden position, and either one of the object B as shown in FIG. 2(*b*), or the object C as shown in FIG. 2(*c*) appears in the display position. If this changeover action of these objects A, B and C is performed quickly and simultaneously, a phenomenon that an object is suddenly transformed can be easily displayed.

As described above, by changing over the object to be displayed, for example, by changing the color, even if the objects A, B and C are the same object, a phenomenon that an object suddenly changes the color can be displayed. Furthermore, even if the objects A, B and C are the same object, the shape or look may be different, or the objects A, B and C may not be the same object, and the object can be optionally transformed by a combination of objects.

Figure 4:
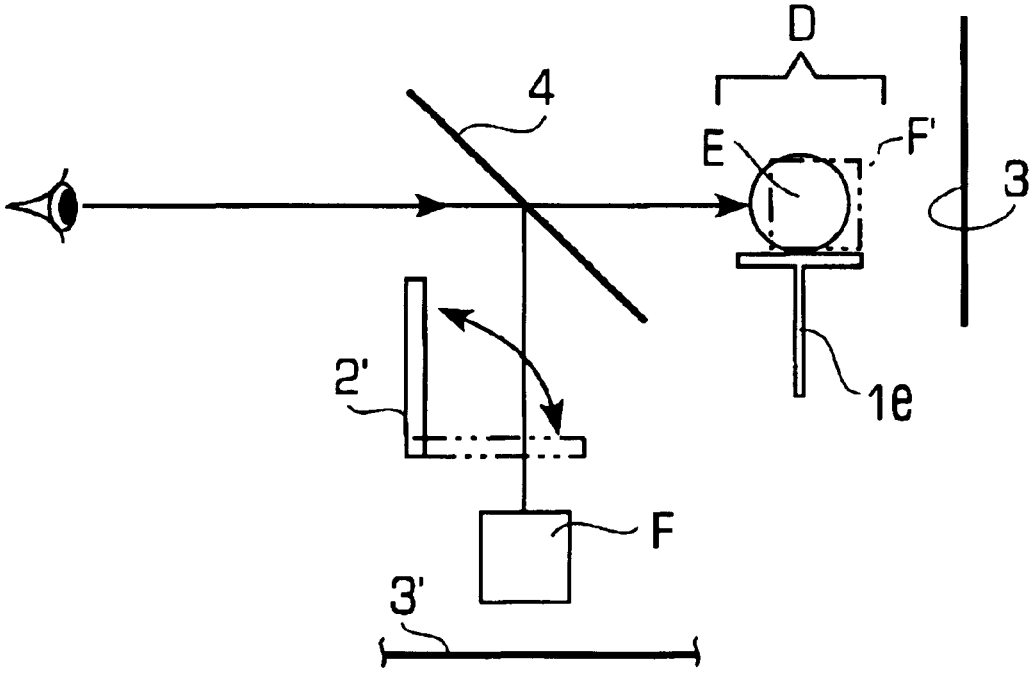
FIG. 4 is a diagram showing another embodiment of the object display apparatus according to the present invention.

FIG. 4 is a diagram showing other embodiment of the object display apparatus, and this apparatus has an object to be displayed E comprising an entity disposed in the display position D and an object to be displayed F provided so that an image F' is displayed in the display position D via a half mirror 4. The object E is movable between a display position and a hidden position, by the appearance/disappearance means constituted as a lift device 1*e*, and with regard to the object F, an image F' in the display position D appears by changing over a screen 2' as the appearance/disappearance means, which is movable between a position where it hides the object and a position where the object is displayed.

Since the object display apparatus can overlap the position of the image P on the object E, it can be so set that positional discrepancy of objects to be displayed is almost removed, thereby it is possible to transform and display the object having reality, compared to the apparatus of the above-mentioned embodiment. In this embodiment, at the back of the display position D, there is, for example, a background board 3 which shows the background. A background board 3' is also provided beneath the object F. In this case, the screen 2' and the background board 3' have the same color, however, it is more advantageous that the background board 3' has a darker color than the background board 3. Thus, by making the color of the screen 2' and the background board 3' which have the same color, darker than that of the background board 3, there is an advantage in that the background board 3' is overcome by the background board 3 and becomes inconspicuous, and movement of the screen 2' is hardly noticed.

As described above, the object display apparatus according to the present invention can transform the object to be displayed with a simple construction.

Figure 5:
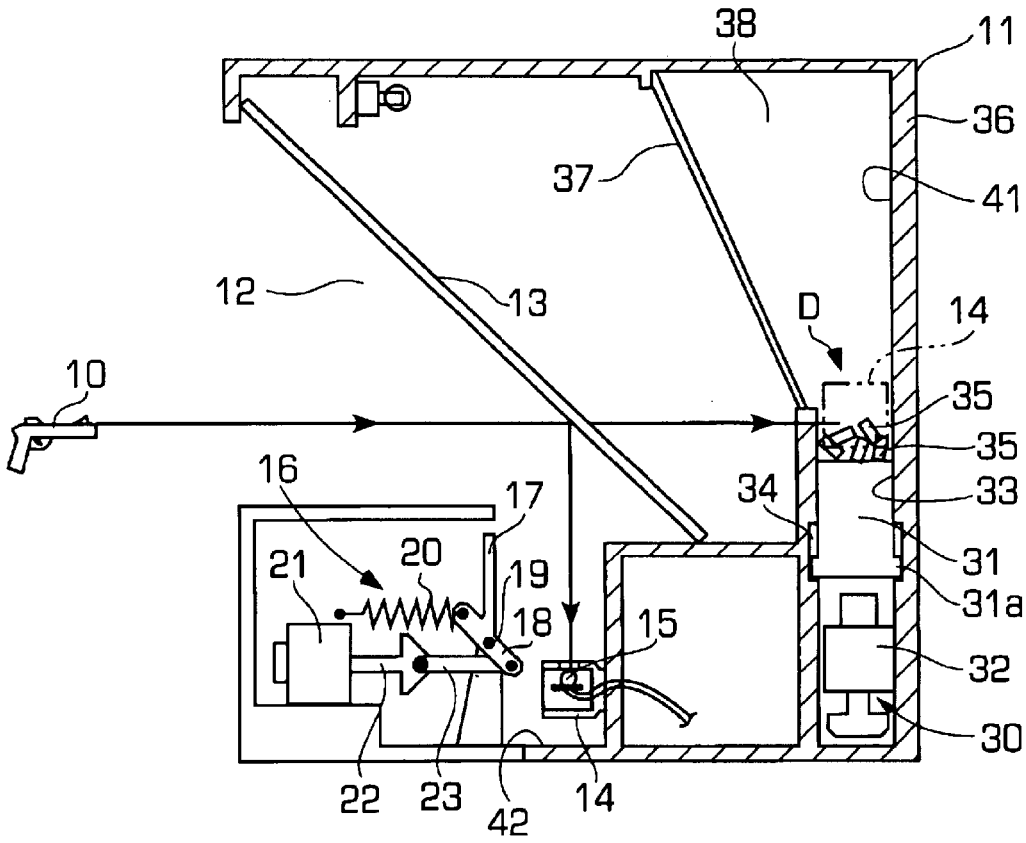
FIG. 5 is a diagram showing one embodiment of an amusement apparatus according to the present invention.

An amusement apparatus using the above-mentioned object display apparatus will now be described. FIG. 5 is a schematic diagram showing one example of a shooting game, and reference numeral 10 denotes a ray gun which rays a ray beam, for example, a xenon ray. A player (not shown) aims a target disposed in the amusement apparatus 11 with the ray gun 10, and the above-mentioned object display apparatus is used as this target apparatus.

In the amusement apparatus body 11, an opening 12 is provided on a plane opposite to the player, and a half mirror 13 tilted obliquely downward is provided in this opening, and the target 14 is in a form before bursting, and its image 14' is reflected by the half mirror 13 and can be seen by the player. Therefore, from the player it seems as if the target 14 is located in the display position D as shown in the chain line. This target 14 is provided with a light-receiving sensor 15 for detecting the xenon ray, and it is so constituted that when the light-receiving sensor 15 detects the xenon ray, a hitting signal is generated.

On the above-mentioned target 14, a screen device 16 is provided as the appearance/disappearance means for displaying an image 14' in the display position D. This screen device 16 has a screen 17 and a supporting portion 18 for supporting the screen 17, and the supporting portion 18 is attached rotatably around a pin 19. To one end of the supporting portion 18, a spring 20 is latched together, whereby rotation force around the pin 19 in the counter-clockwise direction in the figure is always applied to the supporting portion 18. The other end of the supporting portion 18 is coupled to a plunger 22 of a solenoid 21 via a lever 23, and when the solenoid 21 is in an OFF state, the supporting portion 18 is held in a state that the plunger 22 of the solenoid 21 is extended to the longest level. With this state, the screen 17 does not block between the half mirror 13 and the target 14, as shown in a solid line in FIG. 6, hence the image 14' of the target 14 appears in the display position.

At the display position D of the amusement apparatus body 11, there is provided a hitting device 30. The hitting device of this embodiment has a hitting piston 31 as a hitting member, and a solenoid 32 as a hitting driving portion for hitting the hitting piston 31 upward. The hitting piston 31 is vertically movably fitted to a cylinder portion 33 provided in the amusement apparatus body 11. In this case, a flange portion 31*a* is formed at a lower part of, the hitting piston 31, and the flange portion 31*a* is fitted to a guide groove 34 extending in a vertical direction which is provided in the cylinder portion 33, thereby the movable width of the hitting piston 31 is controlled.

On the piston 31 of the hitting device 30 constituted as described above, a plurality of fragmentary targets 35 are placed as the objects to be displayed which show a form of the target 14 at the time of bursting. The fragmentary targets 35 may be made by simulating the fragments of the target 14, or for example, when the target 14 is composed of a cup such as a chinaware, the fragmentary targets 35 may be made by actually smashing a cup of the same type and the same color as the cup. Thus, if actually smashed fragments are used as the fragmentary targets 35, since they have the same feeling and color, reality can be enhanced.

Figure 6:
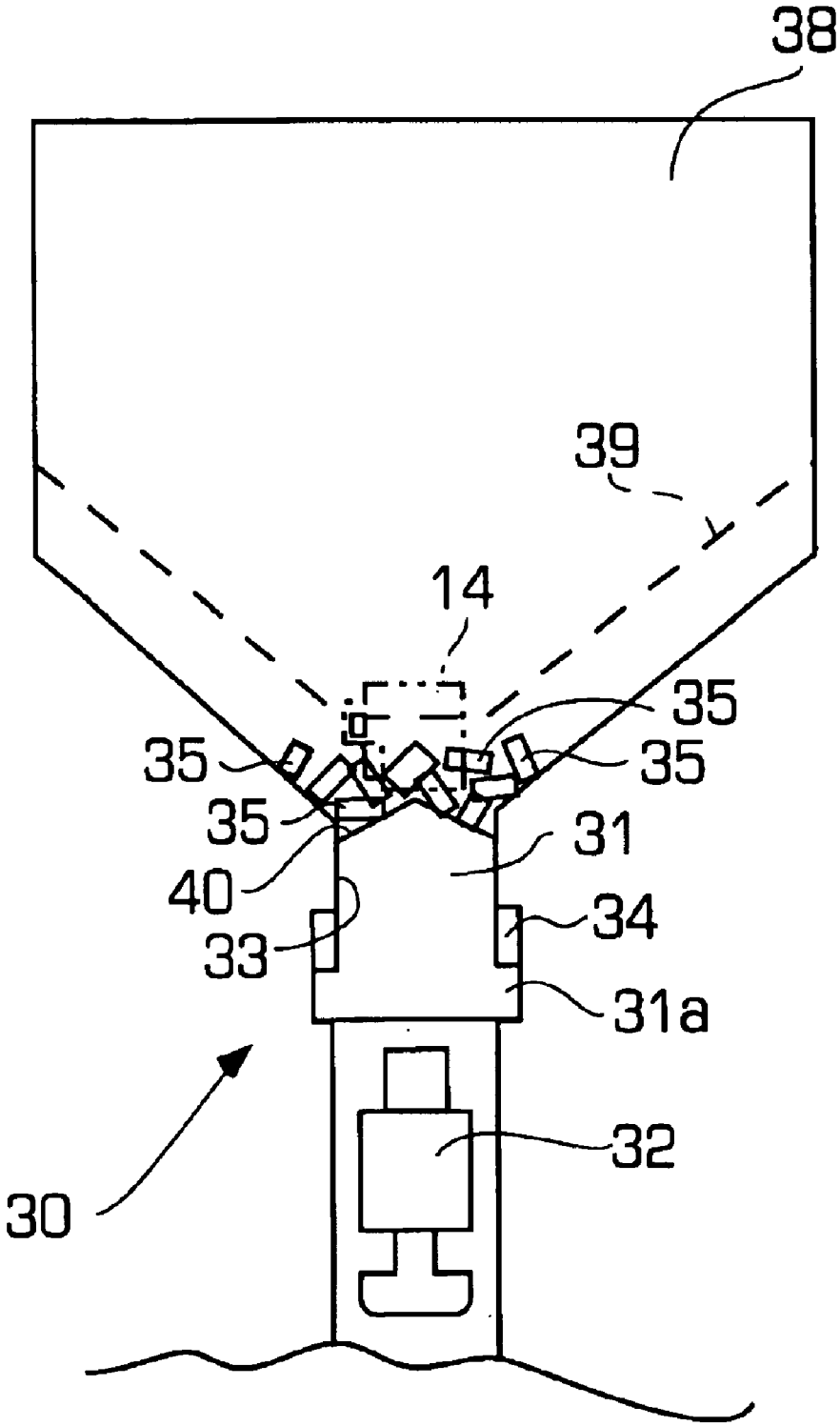
FIG. 6 is an elevational diagram of FIG. 5.

As shown in FIGS. 5 and 6, a closed space 38 is formed by respective frames 36 on the upper side, right and left sides, and both sides of the amusement apparatus 11 and a transparent plate 37, and as shown in the drawing, this closed space 38 is so formed that the depth direction thereof is gradually enlarged as going upward, as seen from a player. The bottom of the closed space 38 is so formed that it is in a shape of a funnel in the horizontal direction and inclined so that the center is in the lowermost position, and at the lowermost position the hitting piston 31 is located. Therefore, when the fragmentary targets 35 lifted by the operation of the hitting device 30 fall down, they automatically return onto the hitting piston 31 due to the shape of funnel, thereby it is not required to recover the scattered fragmentary targets 35. If a player can see the fragmentary targets 35 falling down along the shape of funnel, the player will lose interest in the game by half. Accordingly, a hiding member 39 is provided in the transparent plate 37 or in the vicinity thereof, as shown in a dotted line in FIG. 6.

When the fragmentary targets 35 are lifted, it is preferred that they scatter on all sides rather than most of them are biased to one direction, to represent a powerful burst. In particular, it can be said that it is preferred to lift the fragmentary targets 35 so that they scatter in the horizontal direction, as seen from the player. Accordingly, the upper shape of the hitting piston 31 is formed in a hill-shaped protrusion 40, as seen from the player. If the hill-shaped protrusion 40 is provided on the hitting piston 31, the fragmentary targets 35 are lifted so that they scatter in the horizontal direction, thus a powerful burst can be displayed. In addition, the protrusion 40 may be triangular, semicylindrical, or trapeziform.

Furthermore, in this embodiment, at a portion where the side inner face 41 of the side frame 36 which is the back side of the display position D is seen from the player as a background, the bottom inner face 42 of the bottom frame beneath the target 14 is also seen as the background. Therefore, when the screen 17 hides the target 14, the color of the plane opposite to the half mirror 13 is made the same color as that of the bottom inner face 42. Moreover, the color of the screen 17 and the bottom inner face 42, which are the same color, are made slightly darker than that of the side inner face 41. Thus, the color of the screen 17 and the bottom inner face 42 is overcome by the color of the side inner face 41 and becomes inconspicuous, thus there is an advantage in that the movement of the screen 17 is hardly noticed.

The operation of the amusement apparatus constituted as described above will now be described.

In FIG. 5 and FIG. 6, this amusement apparatus is in a state that the play has just been started, and in this state, the screen 17 is in a position where the image 14' of the target 14 shown in FIG. 5 appears in the display position D. Here, the player fires the gun 10, aiming at the image 14' of the target 14. When the xenon ray irradiated by the gun 10 hits the light-receiving sensor 15, the solenoid 21 of the screen device 16 and the solenoid 32 of the hitting device 30 are turned ON simultaneously.

Figure 7:
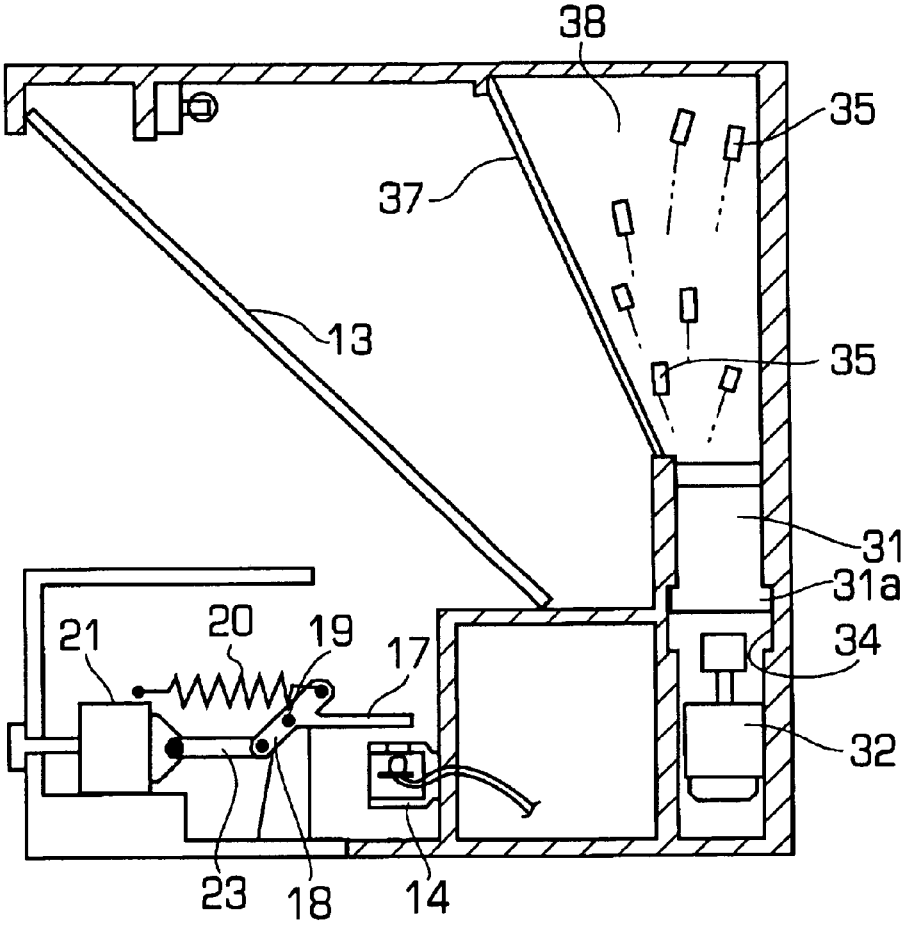
FIG. 7 is a schematic diagram showing the time to display a burst in FIG. 5.
Figure 8:
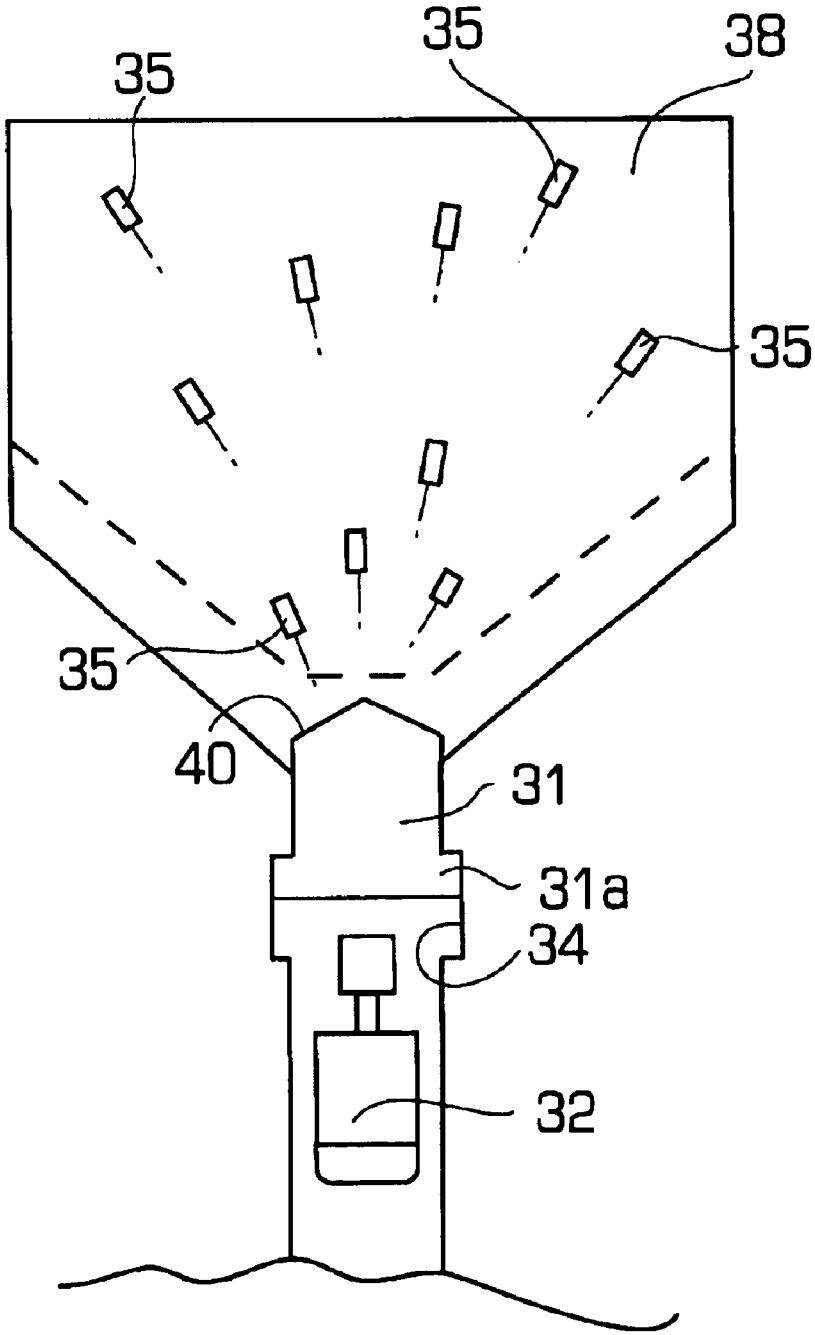
FIG. 8 is an elevational diagram showing the time to display a burst in FIG. 6.
Figure 9:
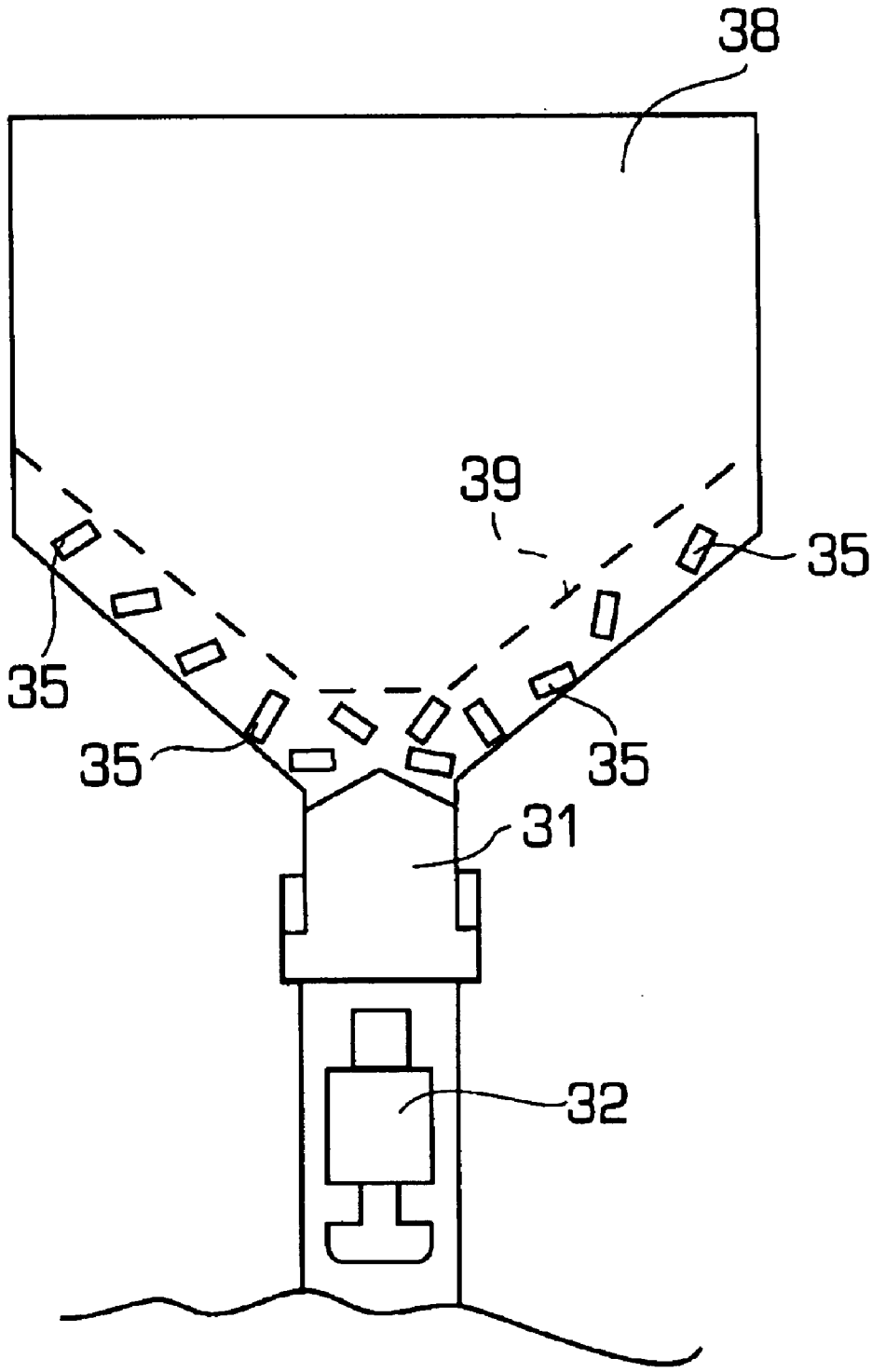
FIG. 9 is an elevational diagram showing the time to recover fragmentary targets in FIG. 6.

When the solenoid 21 of the screen device 16 is turned on, as shown in FIG. 7, the plunger 22 is dragged to the left in the figure, and the supporting portion 18 is rotated in the clockwise direction around the pin 19, against the action of the spring 20, and the screen 17 moves to a position between the target 14 and the half mirror 13, to hide the target 14. Therefore, the image 14' which has been displayed in the display position D is extinguished. On the other hand, when the solenoid 32 of the hitting device 30 is turned on, as shown in FIG. 7 and FIG. 8, the hitting piston 31 is guided by the cylinder 33 and moves upward in the winking of an eye, and lifts the fragmentary targets 35 upward. The lifted fragmentary targets 35 are scattered in the horizontal direction on an average in the closed space 38 by the hill-shaped protrusion 40 of the hitting piston 31, and the player can see the situation through the transparent plate 37 in the closed space 38. As shown in FIG. 9, the lifted fragmentary targets 35 are returned on the hitting piston 31 along the shape of funnel, and this returning motion cannot be seen by the player, because a hiding member 39 is provided.

As described above, with the amusement apparatus, when the target 14 is hit, fragmentary targets 35 which are actual objects are scattered upward instead of the image 14', thereby a burst having reality and punch can be displayed.

Furthermore, since the fragmentary targets 35 are returned onto the hitting piston 31 immediately after lifting, the subsequent play can be prepared in a short period of time.

Figure 10:
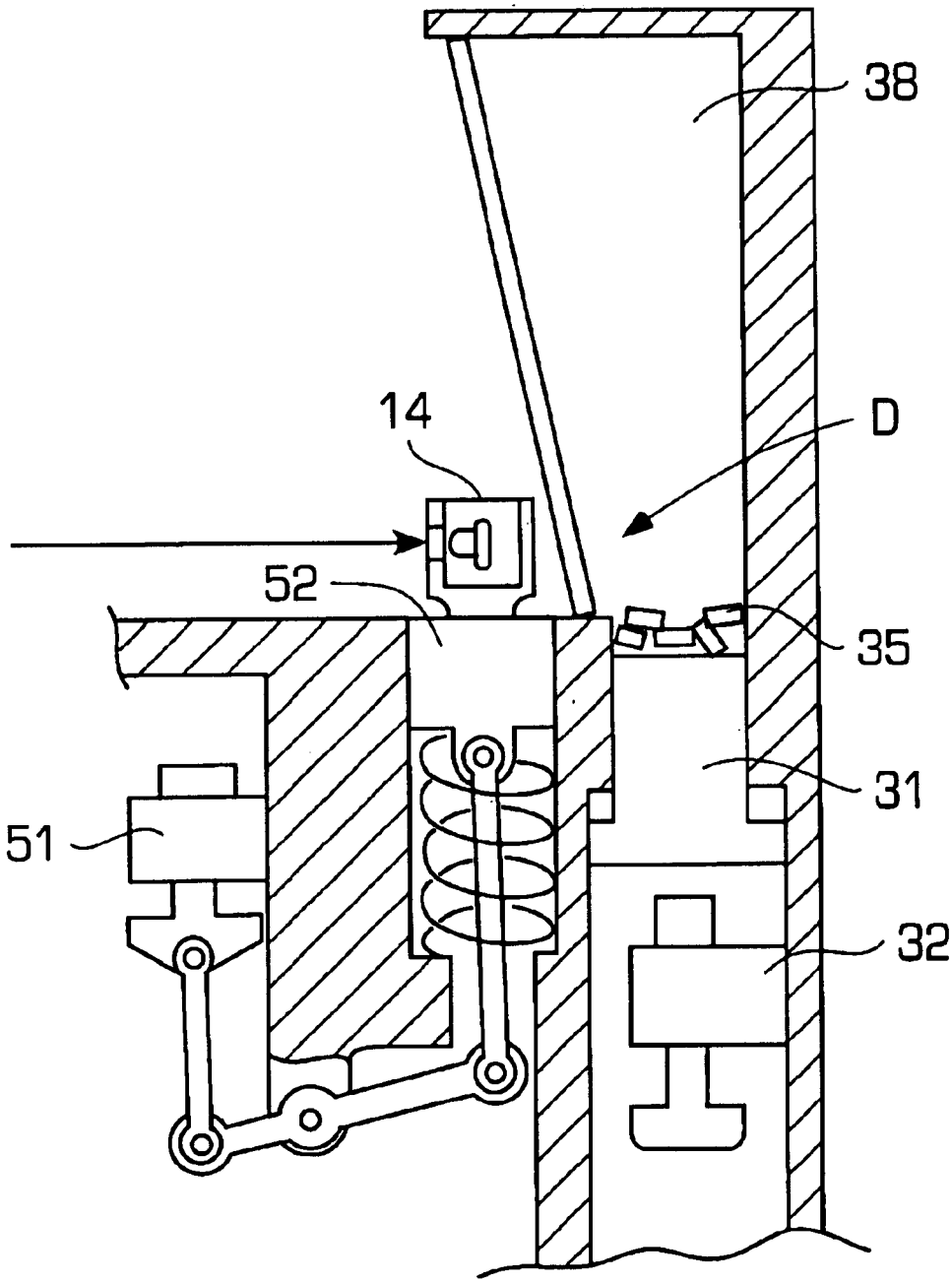
FIG. 10 is a diagram showing another embodiment of an amusement apparatus according to the present invention.

FIG. 10 shows another embodiment of the amusement apparatus according to the present invention, and in this embodiment, the target 14 is disposed in front of the hitting device 30 which lifts the fragmentary targets 35 as seen from the player. That is to say, the target 14 and the fragmentary targets 35 are disposed in parallel in the display position D in the direction of eyesight. The target 14 is fixed on the lifting body 52 which is moved vertically by a solenoid 51, and moved between a position where it appears in the display position D and a position where it is hidden by switching ON/OFF of the solenoid 51.

The amusement apparatus constituted as described above can display a burst without using a half mirror, and when a hitting signal is generated, the target 14 is hidden and the fragmentary targets 35 are scattered upward, hence a burst can be displayed having reality and punch.

Figure 11:
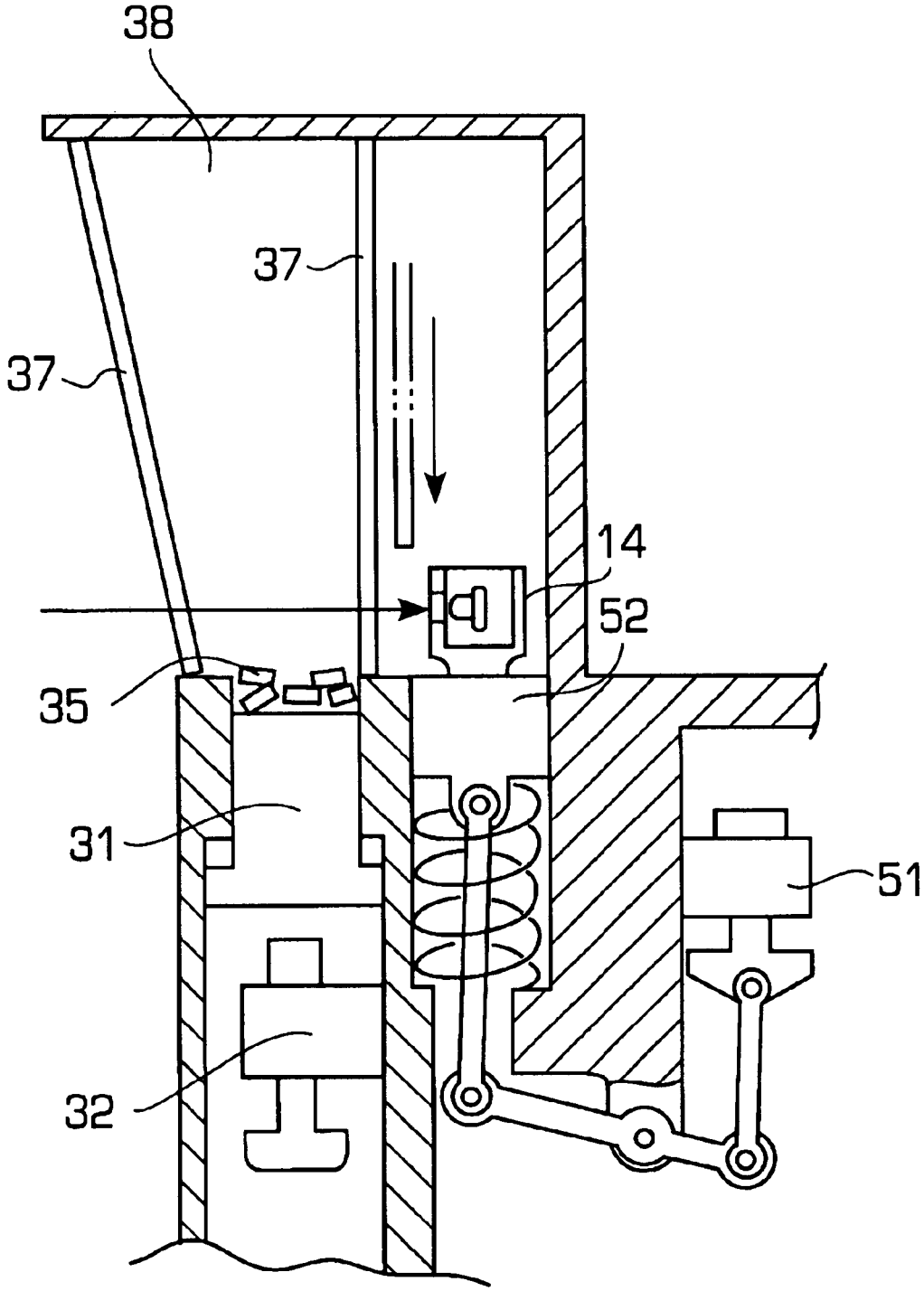
FIG. 11 is a diagram showing a variation of FIG. 10.

FIG. 11 is a variation of the embodiment shown in FIG. 10, and in this embodiment, the target 14 is disposed at the back of the hitting device 30 which lifts the fragmentary targets 35, as seen from the player. In this case, both side plates forming the closed space 38 are composed of transparent plates 37, so that the target 14 at the back thereof can be seen from the player. The target 14 is fixed on the lifting body 52 which is moved vertically by the solenoid 51, and moved between a position where it appears in the display position D and a position where it is hidden, by turning ON/OFF of the solenoid 51.

In the amusement apparatus constituted as described above, since the fragmentary targets 35 which are actual entities are scattered upward instead of the target 14 by the hitting signal, a burst can be displayed having reality and punch.

Preferred embodiments of the present invention have been heretofore described, however the present invention is not limited to the embodiments described above, and can be variously modified. For example, in the above amusement apparatus, the hiding device and the lifting device are moved by using a solenoid, but they may be moved by using a cam or the like. Moreover, realistic and powerful burst display can be obtained, not only in the shooting game using a gun, but also in a game in which a target is aimed, for example, with a simulated artillery. In this case, it is more effective if a model of a combat car, a ship or the like is used as a target instead of a cup. Furthermore, the burst display used in the amusement apparatus of the present invention is also effective to a burst display in a game in which a pre-set bomb, for example, a time bomb or a land mine is exploded.

(f) Effects of the Invention

With the object display method or apparatus according to claims 1 to 10, replacement of objects to be displayed can be displayed with a simple construction, and the objects to be displayed can be transformed in the winking of an eye.

With the amusement apparatus according to claims 11 to 22, a burst display having reality and punch can be obtained, and players are given an incentive to play the game.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. An object display apparatus comprising:

a plurality of objects to be displayed in a display position visible from a generally predetermined direction; and appearance/disappearance means, provided for each object, for changing each object between a state in which it appears in said display position and a state in which it is hidden from view;

wherein only one object appears in said display position while other objects are hidden;

wherein when said appearance/disappearance means of the object appearing in said display position is operated and that object is hidden, then an appearance/disappearance means of a hidden object is simultaneously operated to display said hidden object in said display position, wherein said appearance/disappearance means includes a half mirror that displays an image of an object, and includes a screen that hides an image of the object by blocking the half mirror.

2. An object display apparatus according to claim 1, wherein the screen for hiding the image of the object appearing in said display position via said half mirror and a background of the object appearing in said display position have a darker color than that of a background of an object disposed in said display position.

* * * * *